United States Patent [19]

Podrini

[11] Patent Number: 4,526,668

[45] Date of Patent: Jul. 2, 1985

[54] DEVICE FOR THE ELECTROLYTIC TREATMENT OF METAL STRIP

[76] Inventor: Maurizio Podrini, Via Castel del Rio n. 9, 00127 Roma, Italy

[21] Appl. No.: 607,445

[22] Filed: May 7, 1984

[30] Foreign Application Priority Data

May 16, 1983 [IT] Italy ..... 48299 A/83

[51] Int. Cl.[3] ..... C25D 17/00

[52] U.S. Cl. ..... 204/206

[58] Field of Search ..... 204/206

[56] References Cited

U.S. PATENT DOCUMENTS 2,317,242 4/1943 Allen ..... 204/206
2,535,966 12/1950 Teplitz ..... 204/206
2,910,422 10/1959 Egge ..... 204/206
3,880,744 4/1975 Idstein ..... 204/206
4,434,040 2/1984 Brendlinger ..... 204/206

*Primary Examiner*—Thomas Tufariello
*Attorney, Agent, or Firm*—Young & Thompson

[57] ABSTRACT

Apparatus for the continuous electrolytic treatment of metal strip of the type having at least two separate vertically superposed chambers connected with each other by two vertical ducts the internal walls of which are formed by fixed electrodes. The electrolyte flows through these ducts, from the upper chamber into the lower one, the electrolyte being removed from the lower chamber and introduced into the upper chamber. The lower lips of the ducts extend below the surface of the electrolyte in the lower chamber. The ducts project downwardly into the lower chamber for at least half the height of the lower chamber.

3 Claims, 1 Drawing Figure

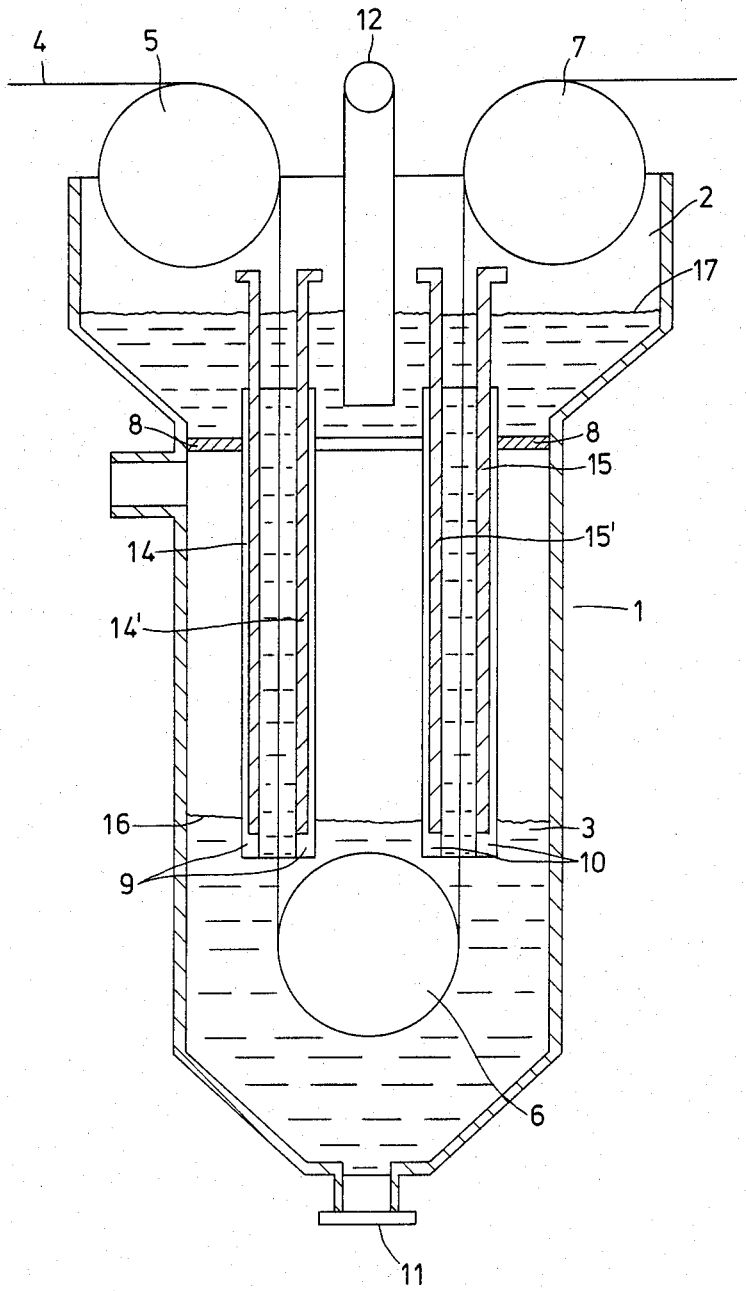
4
5
12
7
2
17
8
8
15
15'
14
14'
1
16
3
10
9
6
11

DEVICE FOR THE ELECTROLYTIC TREATMENT OF METAL STRIP

SUMMARY

The device according to the present invention concerns a vertical cell for electrolytic treatments preferably with a high current density, in which the necessary high relative velocity of electrolyte and strip is achieved by creating and maintaining a given difference in the hydraulic head between the electrolyte contained in an upper distribution chamber and the electrolyte contained in a lower collection chamber.

DESCRIPTION

The present invention relates to a device for the electrolytic treatment of metal strip and, more specifically, to a cell for electrolytic treatment and for the deposition of metal and/or non-metal coatings on metal strip, for example steel strip. There is a generally recognised trend, due essentially to the need to increase the useful life of products made of metal strip and particularly of steel strip, to produce strips coated on one or both surfaces by metals, metal alloys or metal compounds which protect the strip, and therefore the products manufactured from it, from corrosion.

Such coatings may be produced, essentially, in one of two ways: either by immersion of the strip in a bath of molten metal or alloy, or electrolytically.

Both coating techniques have advantages and disadvantages. Electroplating makes it possible to produce coatings which could not be obtained by other means, such as those with alloys whose components differ greatly in melting point, or with oxides or other compounds which are difficult to melt or which decompose when hot. On the other hand, it does not generally produce thick coatings when used at industrial speeds. This is because the gases released in the electrolytic process, oxygen at the anodes and hydrogen at the cathodes, adhere to the electrodes and produce physical defects in the coating, causing a drop in the treatment current. To minimise these effects, it is necessary to work with a relatively low current density, unless very long treatment times, which are not economical industrially, are used.

Electrochemical deposition has so many advantages that a great deal of effort has been made to overcome the problems described above.

Recently, a very simple method has been proposed and used. This consists in eliminating the gases by forcing the electrolyte in the opposite direction to the strip being treated at a particular speed. In reality, the important thing to achieve is a given relative velocity between the strip and the electrolyte, both of which are moving, so as to simultaneously carry off the gas from the electrodes and achieve a sufficient rate of change of the electrolyte on the strip, so as to ensure the optimum concentration of the element or elements to be deposited along the whole length of the electroplating cell. On the basis of these considerations, there has been developed, according to the present invention, a vertical cell for high current density electroplating and electrolytic treatment. This has the advantage over horizontal cells that gas removal is better and less floor space is occupied.

According to the present invention, the elementary vertical treatment cell is composed of a container in which there are two, rectangular sectioned vertical ducts. These constitute the electrolytic treatment cells, in which the electrolyte is forced to move vertically.

This is made possible by the fact that the said container is divided vertically into at least two chambers. The electrolyte is forced to pass from one chamber to the other through the aforesaid rectangular sectioned vertical ducts. The aforesaid container has a relatively small upper chamber and a larger lower chamber. These chambers, upper and lower, are connected by the aforesaid rectangular sectioned vertical ducts, which project for a certain height into the upper chamber and downwards extend to at least the half way point in the lower chamber. The electrolyte is pumped into the upper chamber through one or more tanks for its collection and adjustment of the concentration of the elements to be deposited. The electrolyte in the lower chamber is kept at a certain level, above the lower lip of the said vertical ducts. The electrolyte falls from the upper chamber to the lower through the rectangular sectioned vertical ducts, which constitute the electrolyic treatment cells. The difference in level between the electrolyte in the upper chamber and that in the lower determines its rate of flow through the treatment cells. The strip to be treated passes downwardly in the first cell and then, passing around a roller, upwardly in the second. By suitably regulating the difference in the level of electrolyte between the upper and lower chambers in relation to the speed of the strip, one achieves, both in the first cell, where the strip and electrolyte flow in the same direction, and especially in the second, a relative velocity between strip and electrolyte which is sufficient to remove the gases and maintain the concentration of the electrolyte within the optimum range.

The larger side walls of the said electrolytic cells constitute the fixed electrodes. The strip to be treated runs at an equal distance between the two and constitutes the electrode of opposite polarity.

The present invention will now be described in greater detail, purely to provide an example and not constituting any limitation, in relation to the attached drawing, which, is a side elevation of an elementary cell of embodiment of the device.

In the drawing, the container is divided by a partition, 8, into an upper chamber, 2, and a lower chamber, 3, connected together through the rectangular sectioned electrolytic cells 9 and 10, whose larger internal faces are constituted by the electrodes 14 and 15.

The strip, 4, guided by the rollers 5, 6 and 7, enters the container, passes through cell 9 downwardly, is then reversed and passes through cell 10 upwardly. The electrolyte, introduced into chamber 2 by the pipe 12, reaches a level 17 and overflows into cells 9 and 10. Flowing down through them, it reaches the lower chamber 3, from which it is pumped through the pipe 11, in such a way that its level, 16, is always above the lower lip of the cells 9 and 10. The difference in level between the liquid surfaces 17 and 16 regulates the speed of flow of the electrolyte within the said cells 9 and 10.

In electroplating, the fixed electrodes may be either soluble or insoluble.

In the case of electroplating on only one face of the metal strip, two homologous fixed electrodes, preferably 14' and 15', are replaced by plates of insulating material which extend within the treatment chambers to where they made contact with the surface of the strip not to be coated, thus shielding it especially at the edges, from current dispersion round the edges.

As indicated previously, the present invention lends itself to a great number of possible electrolytic and electroplating treatments with metals, alloys and compounds. By suitably combining a given number of cells, all identical, it is possible to carry out cleaning and pickling treatments of the strip as well as single and multi-layer coatings of different compounds and metals.

Some of these possibilities are described in the following examples.

EXAMPLE 1

The device which is the subject of the present invention is used for neutral electrolytic pickling of hot rolled strip subjected to mechanical scale-breaking treatment by known methods.

In this application the fixed electrodes are of mild steel for the anodic cells and of lead or lead-coated steel for the cathodic cells. The strip to be treated is subjected to 20 alternate cycles of cathodic and anodic polarity. 20 elementary cells according to the invention are therefore employed in this device and the strip functions alternately as anode and as cathode in these.

The electrolyte is an aqueous solution of sodium sulphate, concentration 200 g/l at a temperature of 85° C., with a pH of 7.0.

Under these conditions, strip velocities from 120 to 160 m/min were tried with current densities between 75 and 100 A/dm$^2$. In every case the strip turned out perfectly pickled, with a clean bright surface markedly resistant to rusting during the storage period.

Under the same conditions but with a lower number of cells (4 elementary anodic-cathodic cells) the surfaces of cold-rolled mild steel strip, low alloy steel and micro-alloy steel strip were prepared for coating by light pickling and activation of the surface. The treatment lasted between 0.25 and 4 seconds. The results in terms of cleanness and surface quality of the strip were excellent in this case, too.

EXAMPLE 2

Cold-rolled annealed and skinpassed strip, preferably pretreated as per the previous example, was electrolytically galvanised. The treatment solution contained from 60 to 80 g/l of zinc ions in acid aqueous solution at pH between 0 and 2, and at temperatures between 40° and 60° C.

Many trials were carried out in the range of conditions described above. In this case the strip always functions as a cathode, while the anodes were either insoluble, of lead alloy, or soluble, of zinc.

The plant consisted of 12 elementary cells in series. Under each of the conditions tested, with a fixed strip velocity of 90 m/min, and using current densities of 100, 120 and 135 A/dm$^2$, uniform and compact zinc deposits of 7, 8.5 and 9.5 um respectively were obtained, corresponding to about 50, 60 and 70 g/m$^2$.

From the results obtained it can be seen that, thanks to the rapid turnover of the solution in the deposition cells, the influence of changes in the concentration and temperature of the electrolyte is kept within very narrow limits.

EXAMPLE 3

A strip of galvanised steel, preferably prepared according to the above example, is subjected, according to the invention, to further coating with successive layers of metallic chromium and chromium oxides.

The coating process is carried out in two successive stages. These require one and two elementary cells respectively, in series.

The anodes of the said cells are all of the insoluble type, of lead alloy.

The operating conditions in the first stage cell were as follows:

The composition of the electrolyte was $CrO_3$ 115 g/l; NaF 1.73 g/l; $H_2SO_4$ 0.5 ml/l, $HBF_4$ 0.5 ml/l. The pH was below 0.8, the temperature 45° C. and the current density 85 A/dm$^2$. Under these conditions, with a strip velocity of 50 m/min, 0.45 g/m$^2$ of metallic chromium were deposited.

The operating conditions in the second stage cells were as follows.

The composition of the electrolyte was $CrO_3$ 40 g/l; NaF 1.73 g/l; $HBF_4$ 0.5 ml/l. The pH was 3, the temperature 30° C. and the current density 40 A/dm$^2$.

With a strip velocity of 50 m/min, 0.05 g/m$^2$ of chromium was deposited as oxides.

I claim:

1. Apparatus for the continuous electrolytic treatment of metal strip of the type having at least two separate vertically superposed chambers connected with each other by means of two vertical ducts the internal walls of which are formed by fixed electrodes, through which the electrolyte flows from the upper chamber into the lower one, and means outside said ducts for removing electrolyte from the lower chamber and introducing it into the upper chamber, the lower lips of said ducts extending below the surface of the electrolyte in the lower chamber.

2. Apparatus for the continuous electrolytic treatment of metal strip according to claim 1, wherein said ducts project downwardly into the lower chamber for at least half the height of said lower chamber.

3. Apparatus for the continuous electrolytic treatment of metal strip according to claim 1, wherein the upper surface of the electrolyte in the lower chamber is exposed to the atmosphere.

* * * * *